United States Patent [19]

Rivas et al.

[11] Patent Number: 4,678,039

[45] Date of Patent: Jul. 7, 1987

[54] METHOD AND APPARATUS FOR SECONDARY AND TERTIARY RECOVERY OF HYDROCARBONS

[75] Inventors: Nelson Rivas, Hempstead, N.Y.; Rudi Beichel, Sacramento, Calif.

[73] Assignee: WorldTech Atlantis Inc., New York, N.Y.

[21] Appl. No.: 824,171

[22] Filed: Jan. 30, 1986

[51] Int. Cl.[4] ..... E21B 36/02; E21B 43/24

[52] U.S. Cl. ..... 166/303; 166/57; 166/272; 166/302

[58] Field of Search ..... 166/57, 59, 272, 302, 166/303

[56] References Cited

U.S. PATENT DOCUMENTS

| | | | |
|---|---|---|---|
| 3,279,538 | 10/1966 | Doscher | 166/272 X |
| 3,498,381 | 3/1970 | Earlougher, Jr. | 166/57 X |
| 3,527,303 | 9/1970 | Zwicky | 166/303 |
| 3,980,137 | 9/1976 | Gray | 166/272 X |
| 4,057,106 | 11/1977 | Clingman | 166/303 X |
| 4,244,684 | 1/1981 | Sperry et al. | 166/303 X |
| 4,282,929 | 8/1981 | Krajicek | 166/303 |
| 4,398,604 | 8/1983 | Kajicek et al. | 166/303 |
| 4,441,460 | 4/1984 | Wyatt | 166/303 X |
| 4,454,917 | 6/1984 | Poston | 166/303 |
| 4,499,946 | 2/1985 | Martin et al. | 166/267 X |
| 4,532,992 | 8/1985 | Coenen et al. | 166/272 X |

FOREIGN PATENT DOCUMENTS

| | | | |
|---|---|---|---|
| 2138869 | 10/1984 | United Kingdom | 166/272 |

*Primary Examiner*—George A. Suchfield

*Attorney, Agent, or Firm*—McAulay, Fields, Fisher, Goldstein & Nissen

[57] ABSTRACT

A process is provided for secondary and tertiary recovery of hydrocarbon from hydrocarbon bearing formations. Apparatus for carrying out the process is also provided. Combustion products are formed in a bipropellant generator, the combustion products being at supercritical pressures and temperatures relative to steam. Water and steam are combined with the combustion gases, which may include steam, and forced through the center of a cooling jacket which is provided to cool the walls of the well bore. Chemical additives may be added to the mixture of combustion gases and steam between the bipropellant generator and well bore or below the cooling jacket.

5 Claims, 3 Drawing Figures

METHOD AND APPARATUS FOR SECONDARY AND TERTIARY RECOVERY OF HYDROCARBONS

BACKGROUND OF THE INVENTION

1. Field of the Invention

The present invention generally relates to systems for the production of oil and gas, and more specifically, to a method and to an apparatus for enhancing the secondary and tertiary recovery of oil and gas.

In its infancy, the United States petroleum production industry experienced drilling excesses and overproduction, and accelerated the depletion of major oil and gas reserves. Careless drilling and production practices led not only to waste, but also to contamination. Frequently, such contamination was evidenced by extensive clogging of existing wells due to water infiltration, paraffin buildup, or to the formation of emulsions within the wells. Such fouling decreased the yield and made further production uneconomical. As a result, wells which contain significant reserves of oil and gas have been abandoned. There has been a long standing need to establish an efficient and economical method for enhancing the recovery of oil and gas from marginally producing wells.

The traditional method for the recovery of oil and gas from underground formations includes the use of drilling equipment, fracturing equipment, and pumping equipment. The aforementioned method is termed "primary recovery," because the recovery of the hydrocarbon depends on the pressure energy initially present in the reservoir. The pressure energy contained within the formation provides the force necessary to enable the oil and gas to migrate horizontally into producing wells for recovery. When this energy has been depleted, and the rate of oil recovery becomes uneconomical, oil production can only be increased through the injection of secondary energy into the reservoir. The injection techniques employed are designated as "secondary recovery," because the injection of fluids results in a second phase of oil production. Conventional methods of secondary recovery encompass immiscible displacement processes, such as water flooding and gas injection. After secondary recovery, substantial quantities of oil frequently still remain in the reservoir. Processes that aid in the recovery of oil beyond the primary and secondary recovery methods are referred to as "tertiary recovery" methods.

Tertiary recovery processes entail substantial risk in view of the technical sophistication and "front-loaded" financial investment required. Tertiary processes include such techniques as miscible fluid displacement (carbon dioxide injection), micro-emulsion flooding, thermal flooding (steam flooding or in situ combustion) methods, and other chemical flooding (alkaline or surfactant) methods. All of the above listed methodologies are referred to as "enhanced oil recovery processes." Of available enhanced oil recovery methods, steam injection and in situ combustion have enjoyed the greatest success.

When steam is injected down the well bore and into the formation, steam increases bottom hole pressure and the gravity of the oil, and decreases the viscosity and surface tension of the oil. This method releases more of the oil and gas from the underground formation, enhancing recovery. Steam injection techniques commonly generate temperatures of from about 82° C. to about 248° C. and pressures of from about 500 psi to about 1,500 psi. However, steam injection is by no means free from significant problems. Before one can undertake such a project, the following considerations must be taken into account: availability of water; required water treatment; possible recycling of product water; stack gas cleanup; production treatment at high temperatures; actual production and the attendant pumping problems; generator fuel type and availability; electric power requirements, design of steam injection lines; gathering lines; extent of production-injection automation; required insulation of production lines and tanks at low temperatures; and well completion methods. These are just some of the problems that need to be considered. Hence, large startup costs are always associated with steam injection methods and significant oil reserves are needed to justify the economics of such large projects.

Recently, the use of small, portable gas generators has begun in the oil and gas industry, paving the way for a new era of efficient and economical generation of flooding agents. These gas generators use rocketry engineering principles to generate flooding gases at supercritical temperatures and pressures which are injected to reenergize oil and gas fields. Such advanced recovery methods allow the oil and gas producer to recover the hydrocarbons at an accelerated rate.

2. Prior Art

As indicated, methods and apparatus are known for secondary and tertiary recovery of oil and gas from wells, and many such systems have been described in prior patented art. However, none of this prior patented art describes the process and apparatus of the present invention.

U.S. Pat. No. 4,463,803—Wytt discloses a method and apparatus for generating steam at elevated temperatures and pressures. This system utilizes a fuel, an oxidant, and water in a generator located downhole.

U.S. Pat. No. 4,475,883—Schirmer et al, discloses a bipropellant gas generating system which uses an air-fuel combustion mixture. The combustion takes place at 8% above the stoichiometric ratio (making the reaction oxygen rich), and, again, the generator is located downhole.

Martin et al, U.S. Pat. No. 4,499,946, disclose a bipropellant gas generating system capable of injecting carbon dioxide, nitrogen, and steam at elevated temperatures and pressures. The hot combustion gases are passed sequentially and selectively, and optionally through portable modular units selectively detachable, connectable to the reactor, and to each other. Such units may include a heat exchanger type of boiler to generate steam for downhole injection and/or production of power, a scrubber for removal of any particulate matter should the fuel create such; a catalytic gas purifier for removal of any corrosive material, e.g., hydrogen sulfide, sulfur, sulfur oxides, and nitrogen oxides, etc., should the fuel create such; a gas cooler; a gas drier; and a carbon dioxide absorber. This system makes no provision for the cooling of the injection well walls.

PCT application WO82/01214 in the name of Foster-Miller Associates, Inc., discloses a bipropellant gas generating system disposed downhole and relies on the combustion of an oxidant and a fuel. The gases are injected into the well formation via a converging-diverging nozzle.

A bipropellant gas generating system in which water is injected through slotted inlets along the combustion chamber wall to provide an unstable boundary layer and stripping of the water from the wall for efficient steam generation is disclosed in U.S. Pat. No. 4,385,661—Fox. Pressure responsive doors are provided at the steam outlet of the combustor assembly. The outlet doors and fluid flow functions may be controlled by a diagnostic/control module. The module is positioned in the water flow channel to maintain a relatively constant, controlled temperature.

SUMMARY OF THE INVENTION

The present invention provides a method for secondary and tertiary production of oil and gas from wells that are considered to be of marginal status. In addition, the present invention includes an apparatus for effecting the method, the apparatus being comprised of a bipropellant gas generating system and a chemical additive system, along with means for cooling of the walls of the well bore. This system relies on a bipropellant gas generator to supply exhaust gases at supercritical temperatures and pressures, said exhaust gases being directed downwardly into the bore hole. The supercritical gases, and steam produced by them, enter the formation through an injection well and create a horizontal drive which forces the hydrocarbons in the formation into surrounding production wells. In addition, the supercritically heated-pressurized gases and chemical additives are advantageously used to disintegrate contaminants in both the well bore and in the formation matrix.

The bipropellant gas generator has a chamber wherein a fuel and an oxidant are mixed, ignited, and combusted yielding flooding agents at elevated temperatures and pressures. The bipropellant gas chamber is provided with a jacket through which water flows to cool the chamber. The outlet from the chamber is at a point below the point of combustion, so that the water does not affect the flame and, when the combustion gases, which are at temperatures and pressures supercritical relative to the water, combine with the water, high pressure and high temperature steam is generated and the mixture of combustion gases and steam is driven into the well bore.

The well bore is provided with a double pass water cooling jacket which functions both to protect the well bore casing from damage and to cool the mixture of combustion gases and steam to an appropriate temperature for use in the secondary or tertiary recovery process. This water also passes through a packer, which surrounds the bottom of the cooling jacket and operates as a gasket to seal the upper part of the well from the hot gases. Means are provided to direct the water which exits from this double pass jacket into the outlet from the bipropellant generator, so that all of the water and heat provided are used, with as little waste as possible.

Still further, the outlet from the bipropellant gas generator employs a converging nozzle, rather than a converging-diverging nozzle as in the prior art. The diverging nozzle employed in several prior art systems provides for an unwanted increase in the velocity of the gases which could produce shock waves along the well bore, causing rupture of the cement casing, or of the cooling jacket.

Means are also provided for feeding of additives, particularly chemical treating agents, to the mixture of combustion gases and steam, and preferably at the bottom of the water cooling jacket.

Some or all of the following steps are accomplished in accordnce with the method of the present invention:

1. Insertion and attachment of the double pass cooling jacket into the bore of the injection well.
2. Placement and attachment of the bipropellant gas generator over the injection well bore.
3. Supplying fuel and oxidant to the bipropellant gas generator, and igniting the propellants in the combustion chamber of the generator.
4. Feeding cooling water downwardly into a first section of the double pass water cooling jacket, passing said water through a packer located at the bottom of said jacket, and returning said water upwardly through a second section of said double pass jacket.
5. Feeding heated water obtained from the second section of said double pass water jacket into the outlet of said bipropellant generator.
6. Combining the water from the cooling jacket of said bipropellant generator chamber with said combustion gases to produce a mixture of combustion gases and supercritically heated steam.
7. Passing said mixture of combustion gases and supercritically heated steam through a converging nozzle into the injection well bore, through the center of said double pass cooling jacket.
8. Combining chemical additive treating agents with said mixture of combustion gases and supercritically heated steam at a point below said converging nozzle, and preferably at the end of said double pass cooling jacket; and
9. Recovering hydrocarbons from production wells located in proximity to said injection well.

The bipropellant gas generator of the present invention can operate on a variety of fuels and oxidants, though air and methane are the preferred propellants. The combustion gases produced in accordance with the present invention can exceed 1650° C. after the water which has been employed to cool the combustion chamber of the bipropellant generator is added to the combustion gases, below that chamber, but prior to the converging nozzle; the temperature is preferably reduced to about 250° C. to 500° C. with pressures of from 500 psia to 3000 psia.

If desired, the bipropellant gas generator can be coupled to a computer for automatic operation, shut down, or purging of the system.

DESCRIPTION OF THE PREFERRED EMBODIMENTS

Figure 1:
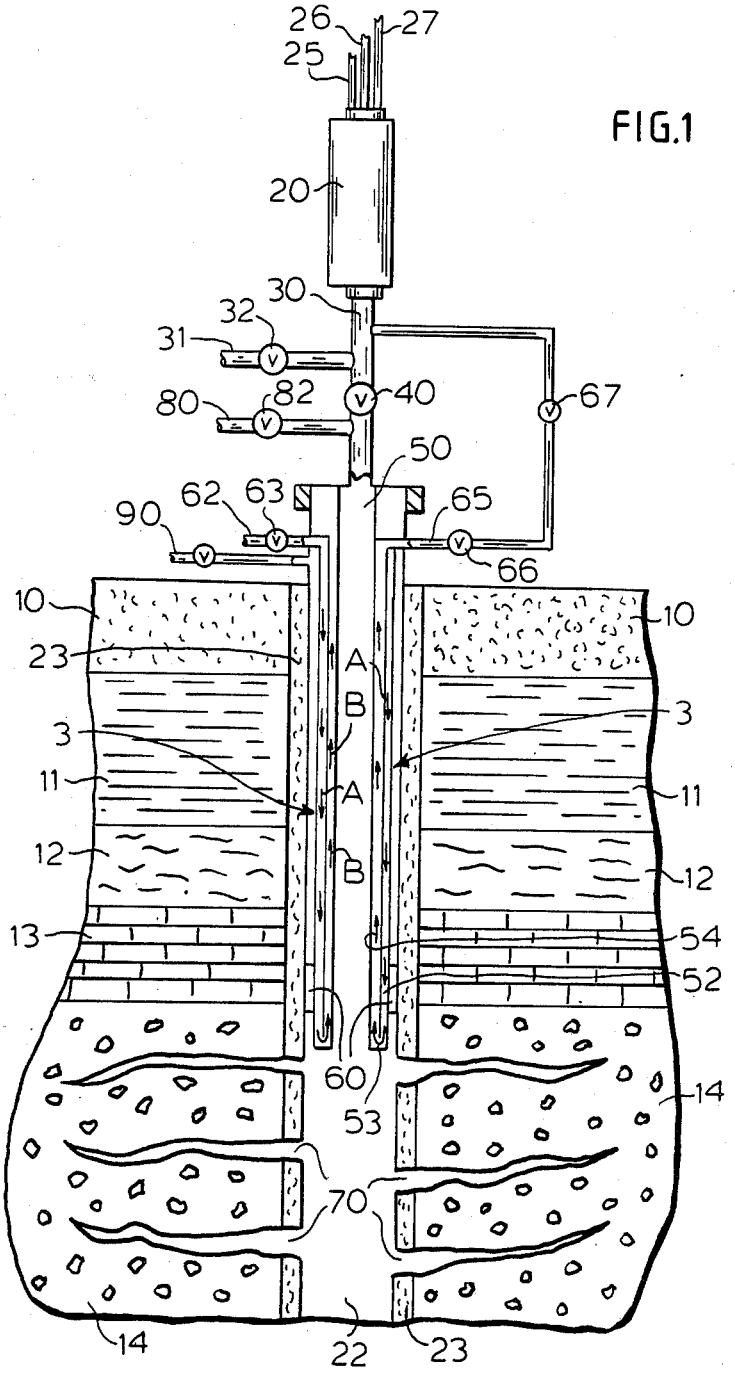
FIG. 1 is an illustration, partially in section, of a formation containing hydrocarbons to be recovered, with a system, in accordance with the present invention, in place, partially in section.

A typical geological formation having hydrocarbon values to be recovered is illustrated in FIG. 1. The formation includes upper strata of sand 10, shale 11, red clay 12, and bed rock 13 overlying a hydrocarbon bearing formation 14. It is into this hydrocarbon bearing formation 14 that the combination of exhaust gases and steam, along with any desired chemical additive, are forced to free the hydrocarbons and move them, horizontally, to a production well.

In accordance with the present invention, a bipropellant generator 20 is shown mounted above well bore 22. As is standard, the walls of the well bore are lined, as at 23, with a material such as concrete.

The bipropellant generator 20 is supplied with fuel via line 25 and oxidant via line 26. Additionally, a cooling fluid, generally water, is supplied via line 27 in a manner which will be described in greater detail below. The exhaust gases formed in the bipropellant generator 20, which include steam resulting from the water formed during combustion along with the steam generated by evaporation of the cooling fluid, is fed through line 30 toward the well bore 22. Line 30 is provided with a vent line 31 which has a valve 32 to control venting. The vent line 31 is supplied to insure proper ignition and, as required, some of the exhaust gases may be vented to the atmosphere, in a minimal amount, in order to control back pressure. This is done to provide favorable ignition conditions within the bipropellant generator. Vent line 31 can also be opened at valve 32 when it is desired to depressurize the system in the event of a misfiring.

Line 30 is also provided with a shut off valve 40 which can be employed to shut in the injection well after treatment of the oil formation is completed, or when a misfiring is experienced.

The lower portion of line 30, below shut off valve 40, is connected to a bore 50 formed by a double pass cooling water jacket as will be described in greater detail below. The double pass jacket is provided with an outer portion 52 through which water flows downwardly, the portion 52 lying closest to the lining wall 23. Upon reaching the bottom 53 of the double pass cooling jacket, the water which has been traveling in the direction of the arrows A reverses, and returns through the passage 54, which is adjacent the bore 50. The double pass cooling jacket is held in place, near the bottom, by a packer 60 which provides a seal between the lining wall 23 and the double pass cooling jacket. The water flowing in the direction of the arrows A also contacts the packer 60 before reversing direction to rise along the inner jacket 54 as illustrated by the arrows B.

Water is fed to the outer jacket 52 through line 62, which is controlled by valve 63. Within the double pass jacket, because of the action of the hot exhaust gases passing through bore 50, the water which passes through the jacket is evaporated to steam which exits from the jacket through line 65 and valve 66. Flow through this line is further controlled by check valve 67 and the steam thus generated enters line 30 to be combined with the combustion gases and steam which are projected from bipropellant generator 20. These thus aid in treatment of the hydrocarbons within the formation 14.

The combustion gases and steam, upon passing the lower portion of the double pass jacket 53, pass through fissures 70 which exist or are formed in the bore lining and enter the hydrocarbon bearing formation 14 where they act upon the hydrocarbons, forcing them, horizontally, toward a production well.

Figure 3:
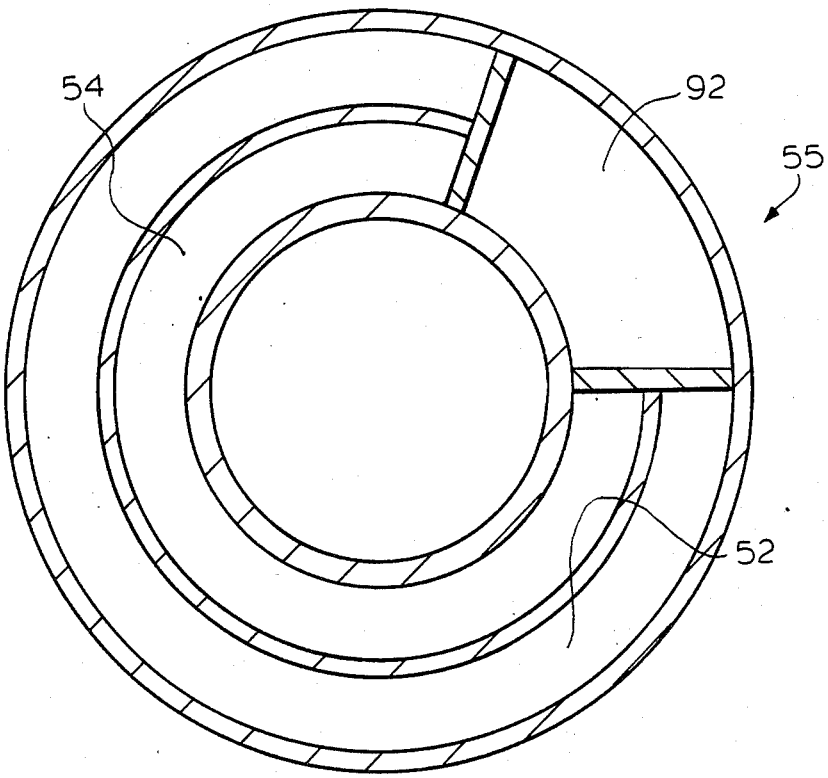
FIG. 3 is a view along the line 3—3 of FIG. 1.

In addition to the combustion gases and steam, it is frequently desirable to treat the hydrocarbons in the formation 14 with a chemical additive. Because such additives are frequently corrosive, contrary to much of the prior art, they are, in accordance with the present process, added after generation of combustion gases by the bipropellant generator 20, rather than into the generator, itself. In some cases, the additives may be added through line 80, which is controlled by valve 82, directly into the mixture of combustion gases and steam. More desirably, in most cases, the additive is added to the combustion gases and steam below the double pass water jacket. To accomplish this, the double pass jacket 55 can be formed with a cross section such as illustrated in FIG. 3, with the outer jacket 52 and inner jacket 54 as illustrated. In addition, a keyway 92 is provided for passage of the additives through the entire length of the double pass jacket 55 to the bottom 53 where they are then combined with the mixture of combustion gases and steam. In this way, not only is the potential corrosive effect of the additives removed from the bipropellant generator 20, but from the bore 50, as well. The additives, as with water, are gasified upon combining with the combustion gas-steam mixture.

Figure 2:
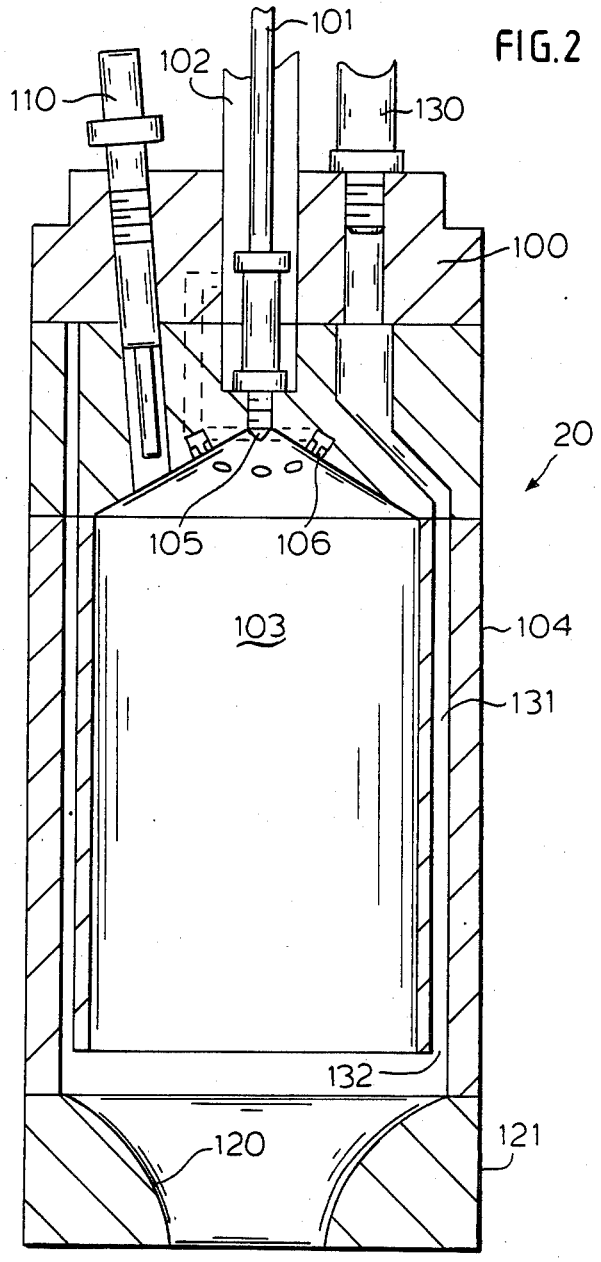
FIG. 2 is a sectional view of a bipropellant generator for use in accordance with the present invention.

A representation of a bipropellant generator 20 which can be employed in accordance with the present invention is illustrated, in cross section, in FIG. 2. Typically, the bipropellant generator has an intake manifold 100 which includes fuel inlet port 101 and oxidant inlet port 102, the two defining a passageway to combustion chamber 103 of the combustion section 104 of the bipropellant generator 20. As illustrated, the fuel enters the chamber 103 through port 105, while the oxidant enters through port 106 and ignition is obtained employing ignition device 110. The combustion cycle is thus begun and the reaction products employed in the process of the present invention are generated at supercritical temperatures and pressures. The exhaust gases which are thus generated are forced through the converging area 120 formed in the manifold 121 and accelerate to a speed approaching mach 1.

In order to avoid overheating in the combustion chamber, a coolant solution, such as water, is introduced through port 130 and circulates through coolant jacket 131. The coolant solution exits the cooling jacket 131 at a point 132 immediately above converging section 120 and, because of the temperature and pressure of the gas combustion products exiting from chamber 103, are immediately vaporized to become part of the stream which acts on the hydrocarbons in the formation 14.

While the fuel employed in the bipropellant generator is, as previously indicated, preferably methane, other liquid and gaseous hydrocarbons can be employed. For example, the fuels which can be used include petroleum distillates and residues, gasoline, kerosene, gas oil, shale oil, oil derived from coal, aromatic hydrocarbons including benzene, toluene, xylene, and mixtures thereof, etc. Among the liquid hydrocarbon fuels which can be used are oxygenated hydrocarbonaceous organic materials including carbohydrates, cellulosic materials, aldehydes, organic acids, alcohols, ketones, oxygenated fuel oil, and mixtures thereof. Also included within the definition of liquid hydrocarbonaceous fuels are pumpable slurries of solid carbonaceous fuels. Pumpable slurries of solid carbonaceous fuels may have a solids content in the range of about 25–70 wt. %, preferably 45–68 wt. %, depending on the characteristics of the fuel and the slurrying medium. The slurrying medium may be water, liquid hydrocarbonaceous fuel, or both. Other fuels which may be used include hydrazine, dimethylhydrazine, and liquid ammonia.

The second propellant employed in the bipropellant generator is an oxidant which may be in either the liquid or the gaseous state. Among the gaseous oxidants which can be employed are air, oxygen, ammonia, and fluorine, air being the preferred oxidant because of its ready availability. Liquid oxidants which can be employed in accordance with the present invention include liquid oxygen, liquid fluorine, hydrogen peroxide, chlorine bifluoride, and nitric acid.

The coolant which enters through port 130 and circulates through jacket 131 is employed, as indicated, to moderate the temperature within the combustion chamber, as well as moderating the temperature of the exhaust gases produced. Coolants which can be employed include air, liquid air, nitrogen, liquid nitrogen, water, and carbon dioxide. Water is the preferred coolant, generally, because of its ready availability. Further, because the temperature of the combustion products is so high, when the coolant enters the stream of moving combustion products prior to the converging section 120, the water is, essentially, flash evaporated to steam, a material which also aids in the treatment of the hydrocarbon bearing formation 14. During shut down, if desired, the system can be purged employing well known purging agents such as air, nitrogen, and water. These purging agents are employed to clean and remove residues and contaminants which remain in the bipropellant generator after an operating cycle and are generally injected through each of the ports of the system.

As previously indicated, the exhaust gases are frequently modified by the injection of chemical additives. Such additives are usually selected from the group consisting of acids, alkalis, and surfactants. The addition of such additives to the exhaust gases both augments and intensifies the fracture forming characteristics of the supercritical gases so as to improve the properties of the hydrocarbons in the formation 14 to aid in their transport to a production well. For example, the viscosity, gravity, and/or surface tension of the hydrocarbon can be affected. Among the acids which can be used are hydrochloric acid, hydrofluoric acid, and combinations. Further, chlorine gas can be injected, directly, certain improved characteristics being obtained by the use of this gas rather than the hydrochloric acid. Among the alkalis which can be employed are sodium hydroxide, sodium carbonate, sodium silicate, ammonium hydroxide, and various combinations of these materials. The surfactants useful in the present invention include such materials as polyoxyethylene alcohols, sodium carboxymethylcellulose, polyvinylpyridine, polyvinyl alcohol, and oleic acid. In general, the additives are more reactive when in a gaseous state, than when in a liquid state, the increase in reactivity frequently being 200% to 300%. However, the additive can be one which is liquid under ambient conditions, but becomes a gas under the temperature and pressure conditions caused by the supercritical combustion gases and steam. Because gaseous materials are not affected by gravity to the same degree as liquids, the effective radius of treatment is increased employing gaseous materials; thus, increased hydrocarbon yields are obtained.

In general, the amount of additive which is employed is from 3 to 15 parts for each 100 parts of combustion gases. Employing the method of the present invention, environmental conditions are improved, along with recovery of the hydrocarbons remaining after primary production. Because all of the exhaust gases generated by the bipropellant generator are forced into the well, the well, itself, acts as a scrubber and the combustion products are not released to the atmosphere. Further, these gases aid in increasing the pressure within the well and, frequently, in otherwise affecting the recoverability of the hydrocarbons. Further, because of the high temperatures employed, sulfur, which may remain in the hydrocarbon formation, is frequently left in the formation as the hydrocarbons are forced to production wells, so that scrubbing or other treatments to remove the sulfur are not required.

Generally, the bipropellant generator is operated with the fuel and oxidant in stoichiometric ratios. However, depending upon the structure of the well formation, it may be desirable, in some cases, to provide either a fuel rich or an oxygen rich mixture. For example, if oxidation of the hydrocarbons in the well formation is to be avoided, then oxygen deficiency might be desirable. On the other hand, if there is a high methane concentration in the well, an oxygen rich exhaust gas might be desired, as further ignition below ground, with added hydrocarbon recovery, would then be possible. Excess carbon monoxide might be used with various types of well formations.

A method and apparatus for secondary and tertiary hydrocarbon recovery in otherwise exhausted wells has been shown and described. The invention should not be considered as limited to the specific embodiments set forth, but only as limited by the appended claims.

What is claimed is:

1. Apparatus for secondary and tertiary recovery of hydrocarbons from oil fields comprising:

a. a bipropellant generator capable of producing exhaust gases at supercritical pressures and tempertures;

b. transport means for carrying said exhaust gases into a well bore, at least a portion of said well bore extending into a hydrocarbon bearing formation from which hydrocarbons are to be recovered;

c. means for introducing water into said transport means; and d. a water cooling jacket extending into at least the upper portion of said well bore, the center of said cooling jacket receiving said exhaust gases from said transport means, means being provided for the introduction of chemical additives through a portion of said cooling jacket.

2. A process for secondary and tertiary recovery of hydrocarbons from geological formations comprising:

a. providing a well bore extending at least into the strata of said geologic formation containing said hydrocarbons to be recovered;

b. providing at least the upper portion of said well bore with a cooling jacket, said cooling jacket being provided with a central, open portion;

c. generating gases at supercritical temperatures and pressures;

d. introducing water into said supercritical gases to form steam;

e. forcing said mixture of supercritical combustion gases and steam through the central open portion of said cooling jacket and said well bore into said hydrocarbon strata; and f. adding chemical additives to said mixture of combustion gases and steam below said cooling jacket.

3. The process of claim 2 wherein said chemical additives are selected from the class consisting of acids, alkalis, and surfactants.

4. The process of claim 2 wherein said additive is a gas.

5. The process of claim 2 wherein said chemical additive is a liquid which is converted to a gas upon addition.

* * * * *